US007914166B2

(12) United States Patent
MacAlister

(10) Patent No.: US 7,914,166 B2
(45) Date of Patent: Mar. 29, 2011

(54) ICE SCULPTURE DISPLAY PLATFORM WITH INTEGRATED WATER COLLECTION AND SELF-POWERED ILLUMINATION

(76) Inventor: Alistair MacAlister, Northboro, MA (US)

( * ) Notice: Subject to any disclaimer, the term of this patent is extended or adjusted under 35 U.S.C. 154(b) by 150 days.

(21) Appl. No.: 12/431,844

(22) Filed: Apr. 29, 2009

(65) Prior Publication Data

US 2010/0277893 A1 Nov. 4, 2010

(51) Int. Cl.
*F21V 33/00* (2006.01)

(52) U.S. Cl. ..... 362/101; 362/253

(58) Field of Classification Search ..... 362/101, 362/154, 253, 234

See application file for complete search history.

(56) References Cited

U.S. PATENT DOCUMENTS

| | | | |
|---|---|---|---|
| 1,043,557 | A | 11/1912 | Young |
| 1,955,674 | A | 4/1934 | Gill et al. |
| 2,674,687 | A | 4/1954 | Priebe |
| 2,939,299 | A | 6/1960 | Sherbloom |
| D192,670 | S | 4/1962 | Chambers |
| 3,684,882 | A | 8/1972 | Mininno et al. |
| 3,710,589 | A | 1/1973 | Brown et al. |
| 3,890,085 | A | 6/1975 | Andeweg |
| 3,966,166 | A | 6/1976 | Elliott |
| 3,990,166 | A | 11/1976 | Nagelkirk |
| 4,164,341 | A | 8/1979 | McComb |
| 4,375,758 | A | 3/1983 | Simmons |
| 4,562,991 | A | 1/1986 | Wu |
| 4,594,646 | A | 6/1986 | Von Kohorn et al. |
| 4,595,094 | A | 6/1986 | Reid |
| 4,616,304 | A | 10/1986 | Von Kohorn |
| 4,646,209 | A | 2/1987 | Jansen |
| 4,669,271 | A | 6/1987 | Noel |
| 4,703,720 | A | 11/1987 | Shipman et al. |
| 4,758,934 | A | 7/1988 | Von Kohorn |

(Continued)

FOREIGN PATENT DOCUMENTS

| | | |
|---|---|---|
| CA | 2161050 AA | 4/1997 |

(Continued)

OTHER PUBLICATIONS

Website: http://www.epartyunlimited.com/super-bright-led-base.html downloaded on Apr. 1, 2008 Super Bright LED Base Red, Blue, Green and White LED's with multi-function features will bring objects to life.

(Continued)

*Primary Examiner* — Laura Tso
(74) *Attorney, Agent, or Firm* — Russ Weinzimmer; Russ Weinzimmer & Associates P.C.

(57) ABSTRACT

An ice sculpture display platform is disclosed that includes integrated water collection and self-powered illumination, thereby enabling display of arbitrarily shaped ice sculptures without requiring a water collection tray or connection to a power outlet. A display surface with drainage holes is supported on or above a water collection bowl, preferably forming a water-tight seal therewith. Battery-powered lights, such as incandescent or LED lights, are attached to the display surface and/or the water collection bowl, and illuminate the ice sculpture from the rim of the bowl, the rim of the platform, and/or from beneath the platform. Lights that illuminate from beneath can be impervious to water and/or sealed within a water-tight enclosure. A portion of the display platform can be transparent, allowing penetration of light originating from below. Batteries can be in water-tight enclosures, and can be in the bowl, under the rim, or under the platform.

19 Claims, 7 Drawing Sheets

U.S. PATENT DOCUMENTS

| | | | | |
|---|---|---|---|---|
| 4,807,844 | A | 2/1989 | Tu | |
| 4,817,911 | A | 4/1989 | Infanti | |
| 4,876,969 | A | 10/1989 | Infanti | |
| 4,905,957 | A | 3/1990 | Stockwell et al. | |
| 4,924,812 | A | 5/1990 | Bernays, Jr. | |
| D309,028 | S | 7/1990 | Von Kohorn | |
| 4,971,737 | A | 11/1990 | Infanti | |
| 4,980,807 | A | 12/1990 | Von Kohorn | |
| 5,010,461 | A | 4/1991 | Saotome | |
| 5,178,451 | A | 1/1993 | Henry | |
| 5,201,577 | A | 4/1993 | Suzuki et al. | |
| 5,211,030 | A | 5/1993 | Jameson | |
| D336,020 | S | 6/1993 | McHale | |
| D348,473 | S | 7/1994 | Griffin, Sr. | |
| 5,372,274 | A | 12/1994 | Freedland | |
| 5,419,856 | A | 5/1995 | Shaw | |
| 5,711,892 | A | 1/1998 | Ramirez | |
| 5,879,071 | A | 3/1999 | Sanford, Jr. | |
| 5,879,153 | A | 3/1999 | Slejertin | |
| 5,947,584 | A * | 9/1999 | Passanante et al. | 362/154 |
| 5,951,154 | A | 9/1999 | Carel et al. | |
| 6,076,940 | A * | 6/2000 | Sanford, Jr. | 362/253 |
| 6,152,575 | A | 11/2000 | Montanino | |
| 6,187,230 | B1 | 2/2001 | Clarke | |
| 6,241,362 | B1 | 6/2001 | Morrison | |
| 6,315,433 | B1 | 11/2001 | Cavello | |
| 6,439,471 | B2 | 8/2002 | Ehrlich et al. | |
| 6,640,558 | B1 | 11/2003 | Zenisek | |
| 6,651,447 | B1 | 11/2003 | Riedesel | |
| 6,799,433 | B1 | 10/2004 | Gleason et al. | |
| 6,814,460 | B1 * | 11/2004 | Su | 362/101 |
| 6,935,070 | B2 | 8/2005 | Ramirez | |
| 7,237,396 | B1 | 7/2007 | Nichol | |
| 2002/0066974 | A1 | 6/2002 | Bell | |
| 2004/0025425 | A1 | 2/2004 | Ramirez | |
| 2005/0232959 | A1 | 10/2005 | Bell | |
| 2006/0158867 | A1 * | 7/2006 | Lee | 362/84 |
| 2007/0164192 | A1 | 7/2007 | Holden et al. | |
| 2007/0247848 | A1 * | 10/2007 | Duwe et al. | 362/253 |
| 2007/0279905 | A1 * | 12/2007 | Chan | 362/253 |

FOREIGN PATENT DOCUMENTS

| | | | |
|---|---|---|---|
| JP | 05004500 | A2 | 1/1993 |
| JP | 08031215 | A2 | 2/1996 |
| JP | 08045336 | A2 | 2/1996 |
| JP | 23242805 | A2 | 8/2003 |
| WO | 08500650 | A1 | 2/1985 |
| WO | 9530865 | A1 | 11/1995 |
| WO | 0065276 | A1 | 11/2000 |

OTHER PUBLICATIONS

Website: http://www.epartyunlimited.com/lyte-base.html downloaded on Apr. 1, 2008 A slim base (8" in diameter) that can be placed under any object you want to illuminate. 13 white LEDs stay constantly lit adding subtle light to any dark corner or the star attraction. Rechargeable, lasts up to 10 hours on a 7 hour charge. Supports up to 100 lbs.

Website: http://www.littlebrightlights.com/site/1435548/page/863736?gclid=CNPMvZCq-5ACFRcesgodRFTn1g downloaded on Apr. 1, 2008 LED Light Bases Use any of our Rechargeable Light Bases or Battery Operated Lighted Bases, including Serving Trays and Coasters.

Website: http://www.hearthsong.com/hearthsong/product.do?section_id=0&bc=1005&pgc=265&country=0&occ=1005&cm_mmc=merc_datafeed-_-product-_-265 &mr:referralID=7ad09470-e013-11dc-8103-000423bb4e79 &mr:trackingCode=NA downloaded on Jun. 16, 2008 3-D Swan mold for an ice sculpture.

Website: http://www.sculpturesinice.com/instructions.htm downloaded on Jun. 16, 2008 Sculptures in Ice Directions for the use of ice sculpture molds.

Website: http://europeangarden.com/ice_lantern.aspx downloaded on Aug. 29, 2008 Ice lantern mold The product, is circular shaped with a center cavity in which a candle can be set after making the frozen lantern.

Website: http://www.find-me-a-gift.co.uk/mathmos-thaw-ice-tealight.html downloaded on Aug. 29, 2008 Mathmos Thaw The Mathmos Thaw includes a stainless steel cylindrical base, stainless steel raised tea-light lid, silicone ice mould, silicone ice mould cover and tea-light candle. The Mathmos Thaw encases a single glowing tea-light candle in ice.

Website: http://www.a-weddingday.com/cgi-bin/ShoppingPlaza/i-shop.cgi?product=centerpiece downloaded on Aug. 29, 2008 Flickering Battery Operated Tea Light Candles The flickering battery operated tea light candles are safe indoor and outdoor. Ideal to light luminaries, centerpieces.

Website: http://www.amazon.com/dp/B0010VRPGA/ref=nosim/?tag=prontocom11132-20&creative=380333 &creativeASIN=B0010VRPGA&linkCode=asn downloaded on Aug. 29, 2008 Small Ice Sculpture Candle Holder Mold with 2 LED Tealights Fill the Mold with water, put in the freezer overnight for a great candle holder!.

Website: http://rockonice.com/elegant_tablecen.html downloaded on Aug. 29, 2008 Elegant Ice Creations.

* cited by examiner

ICE SCULPTURE DISPLAY PLATFORM WITH INTEGRATED WATER COLLECTION AND SELF-POWERED ILLUMINATION

FIELD OF THE INVENTION

The invention generally relates to ice sculptures, and more particularly to platforms for displaying ice sculptures.

BACKGROUND OF THE INVENTION

Ice sculptures are an attractive and popular form of decoration. They can take on many shapes, and can be carved by hand or formed in a mold. Due to their transient nature, ice sculptures are often used to enhance the decorative atmosphere of a special occasion. For example, ice sculptures are frequently displayed at serving tables during festive dining events. Specially arranged lighting is sometimes used to significantly enhance the attractive appearance of an ice sculpture, by shining light through the ice to give it a translucent, illuminated appearance.

While an ice sculpture can be formed into almost any size and shape, the indoor use of illuminated ice sculptures is typically limited to large serving tables and the like, due to the need to connect illuminating lights to a power outlet, and due to the need to manage the water that flows from an ice sculpture as it melts. When an ice sculpture is displayed on a food-serving table, for example, the table is typically placed against a wall for easy access to a power outlet, and the ice sculpture is often placed in a large basin that is partially masked by flowers and/or fruit surrounding the ice sculpture. However, this approach does not enable display of ice sculptures in more general locations, such as the center of a dining table, a coffee table in the center of a living room, or any other location where it is inconvenient to provide space for a water catch-basin, and/or where a power outlet is not readily available.

Special carts have been proposed that include drainage tubes, water collection basins, and power cords all concealed within their structures. However, these carts still require access to a power outlet, and they do not provide for use of ice sculptures in limited spaces and/or in locations that are not close to a power outlet.

A self-contained ice sculpture display platform is known that illuminates an annular-shaped ice sculpture using a candle placed in the center of the annulus, and includes a water-catching bowl located beneath the platform so as to catch water flowing through drainage holes in the platform as the ice melts. While this approach does not require placement near a wall outlet, and is adaptable to small spaces, it is limited in that it is adaptable only to ice sculptures with an annular shape, and can only provide the weak illumination that results from a candle. The proximity of the candle to the ice can also accelerate melting of the ice sculpture.

SUMMARY OF THE INVENTION

An ice sculpture display platform is claimed that includes integrated water collection and self-powered illumination, thereby allowing the platform to be used in small spaces, and to provide strong illumination of an ice sculpture of arbitrary shape without requiring access to a power outlet and without unduly accelerating the melting of the ice. The display platform includes a display surface having drainage holes and resting above a water collection bowl. In preferred embodiments, the display surface forms a water-tight seal with the water collection bowl. Battery-powered lights illuminate an ice sculpture resting on the display surface. The battery-powered lights can be incandescent bulbs and/or LED lights, can be cooperative with the display surface and/or the water collection bowl, and can illuminate the ice sculpture from the rim of the bowl and/or from beneath the display platform in embodiments where at least a portion of the platform is transparent. In embodiments where the battery-powered lights illuminate the ice sculpture from beneath the display platform, the battery-powered lights are impervious to water and/or are sealed within a water-tight enclosure.

The present invention is an apparatus suitable for displaying and illuminating an ice sculpture. The apparatus includes a water collection bowl, a display platform located above the water collection bowl and having dimensions and load-bearing capacity sufficient to support the ice sculpture, the display platform also having at least one drainage hole that is able to allow melting water to drain into the water collection bowl, and a battery-powered light source configured so as to illuminate the ice sculpture.

In preferred embodiments, the display platform can rest on the water collection bowl, in some preferred embodiments the display platform can be attached to the water collection bowl, and in certain embodiments the display platform can form a water-tight seal with the water collection bowl.

In various embodiments the display platform includes a plurality of drainage holes that can allow melting water to drain into the water collection bowl.

In some embodiments the battery-powered light source is an incandescent light. In other embodiments, the battery-powered light source is an LED light. In various embodiments the battery-powered light source is supported by an outer rim of the display platform. And in certain embodiments the battery-powered light source is attached to an under-side surface of the display platform.

In preferred embodiments at least a portion of the display platform is transparent, and the battery-powered light source is configured so as to illuminate the ice sculpture by transmitting light through the transparent portion of the display platform. And in various embodiments the display platform does not include any drainage holes located directly above the battery-powered light source, thereby avoiding exposure of the battery-powered light source to draining water.

In some preferred embodiments the battery-powered light source is attached to the water collection bowl. In other preferred embodiments the battery-powered light source is supported by a rim of the water collection bowl. In certain preferred embodiments the battery-powered light source is impervious to water. And in still other preferred embodiments the battery-powered light source is enclosed within a water-resistant enclosure.

In certain preferred embodiments the apparatus includes a plurality of battery-powered light sources.

In preferred embodiments the battery is surrounded by a water-resistant enclosure. In some preferred embodiments the battery is attached to an under-side surface of the display platform. In other embodiments the battery is supported by an interior surface of the water collection bowl. And in still other preferred embodiments the battery is attached under a rim of the water collection bowl.

BRIEF DESCRIPTION OF THE DRAWINGS

The invention will be more fully understood by reference to the detailed description, in conjunction with the following figures, wherein.

DETAILED DESCRIPTION OF PREFERRED EMBODIMENTS

Figure 1A:
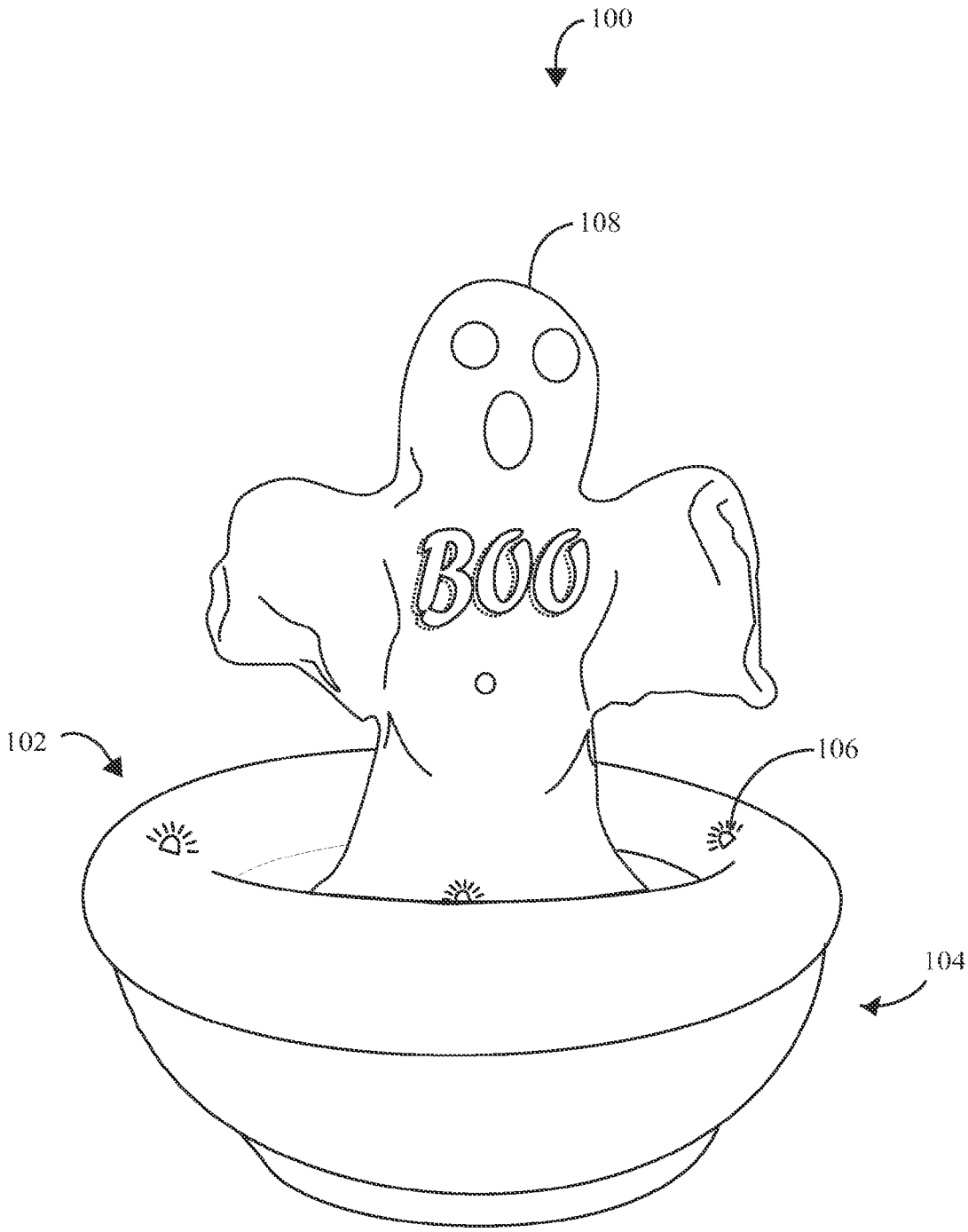
FIG. 1A is a perspective view of a preferred embodiment that includes battery powered lights that are cooperative with the display platform.

With reference to FIG. 1A, the present invention is an apparatus 100 suitable for displaying and illuminating an ice sculpture 108. The apparatus 100 includes a water collection bowl 104 and a display platform 102 that rests on, and preferably attaches to, the rim (114 of FIG. 1C) of the water collection bowl 104. In preferred embodiments, the rim (112 of FIG. 1C) of the display platform 102 forms a water tight seal with the rim 114 of the water collection bowl 104. The display platform 102 and water collection bowl 104 have dimensions and load-bearing capacity sufficient for supporting an ice sculpture 108. At least one battery-powered light 106 is cooperative with the apparatus 100 and configured to illuminate an ice sculpture 108 supported by the display platform 102.

Figure 1B:
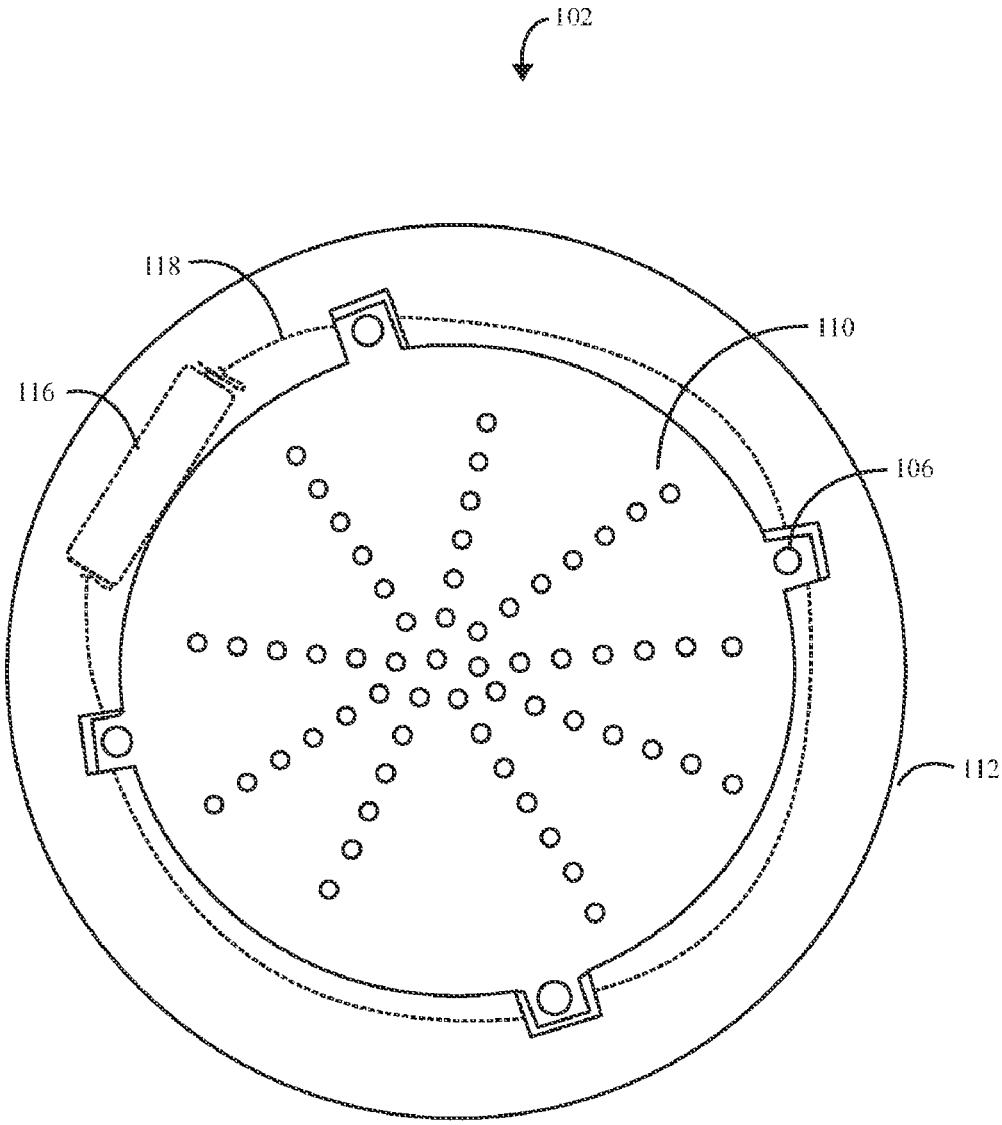
FIG. 1B is a top view of the display platform of FIG. 1A, showing a plurality of drainage holes in the display platform and showing the location of a battery installed under the rim of the display platform.

FIG. 1B presents a top view of the display platform 102 of FIG. 1A. The display platform 102 includes a plurality of drainage holes 110 in the display platform 102 that allow melting water (not shown) from the ice sculpture 108 to drain into the water collection bowl 104. A battery 116 is located beneath the rim of the display platform 102, and is connected by wires 118 to the battery powered lights 106. Some preferred embodiments also include a switch (not shown) that allows the lights 106 to be turned off without removal of the battery 116.

Figure 1C:
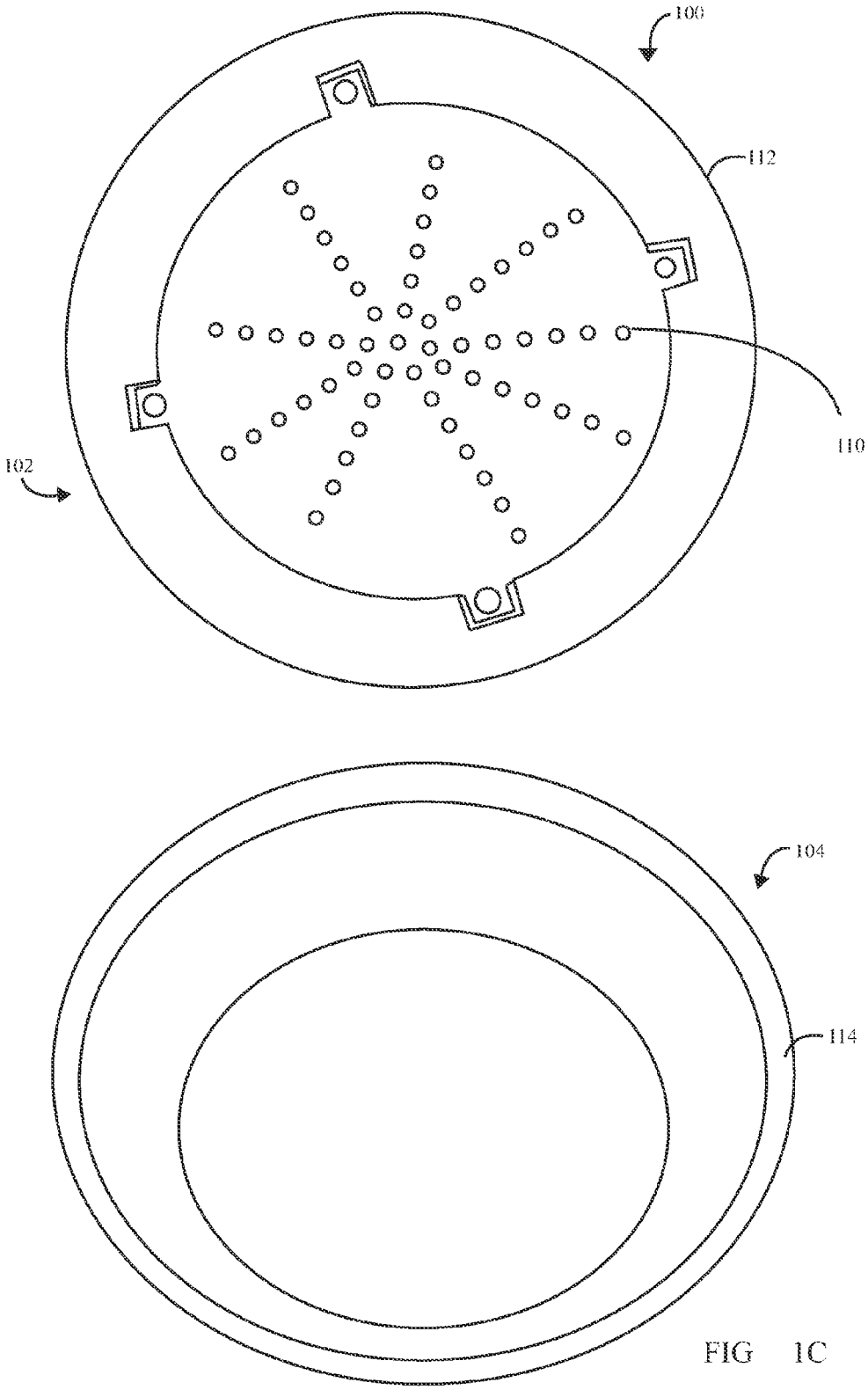
FIG. 1C is a perspective view of the embodiment of FIG. 1A with the display platform and water collection bowl displayed separately.

FIG. 1C is a perspective view of the display platform 102 and water collection bowl 104 of FIG. 1A displayed separately.

Figure 2A:
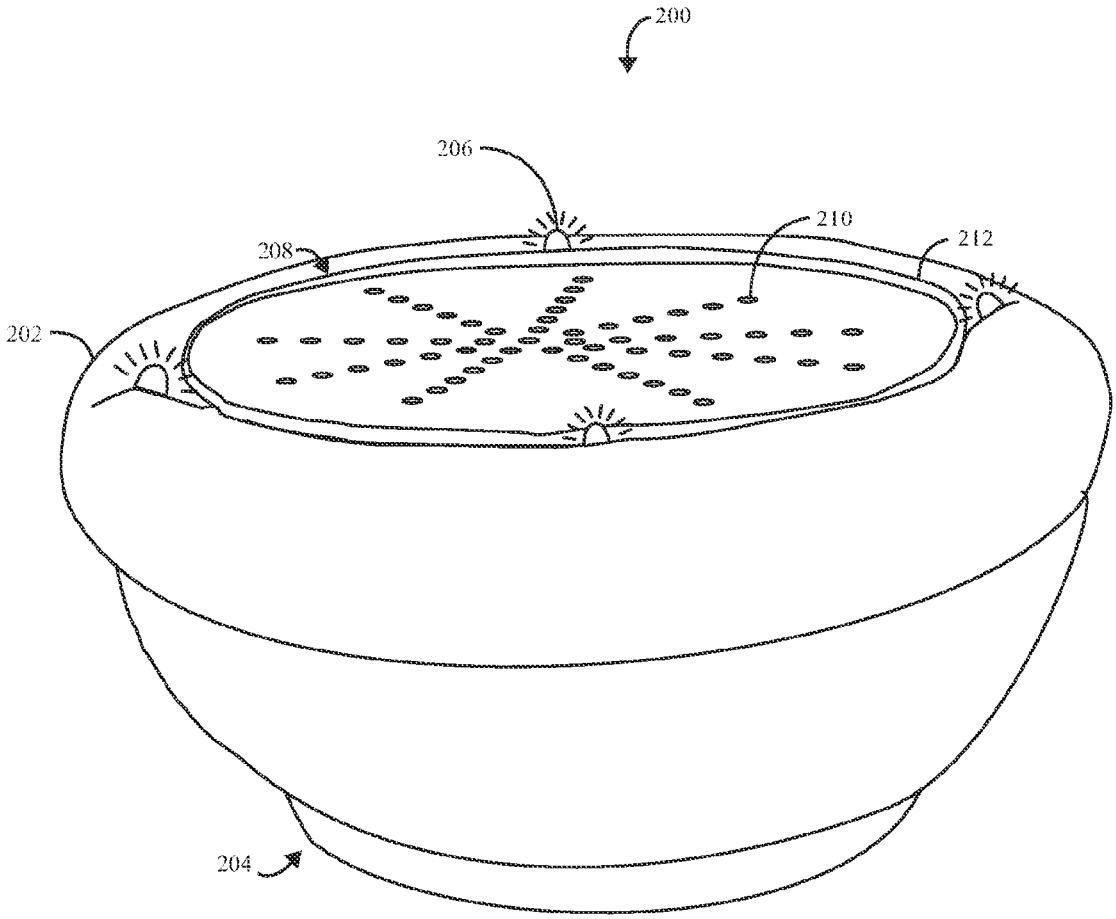
FIG. 2A is a perspective view of an embodiment that includes battery powered lights cooperative with the rim of the water collection bowl and a flat display platform that does not cover the lights.

FIG. 2A is a perspective view of an embodiment 200 in which the battery powered lights are cooperative with the water collection bowl 204. In this embodiment there is a rim 202 around the outer edge of the water collection bowl, and a plurality of battery-powered lights 206 is mounted in the rim 202. A display platform 208 with a flat outer edge 212 rests on a groove (214 in FIG. 2B) formed in the inner part of the rim 202 surrounding the water collection bowl 204. The plurality of battery-powered lights 206 is configured to illuminate the ice sculpture 108 supported by the display platform 208. When an ice sculpture 10 resting on the display platform 208 melts, the water (not shown) drains through a plurality of drainage holes 210 included in the display platform 208.

Figure 2B:
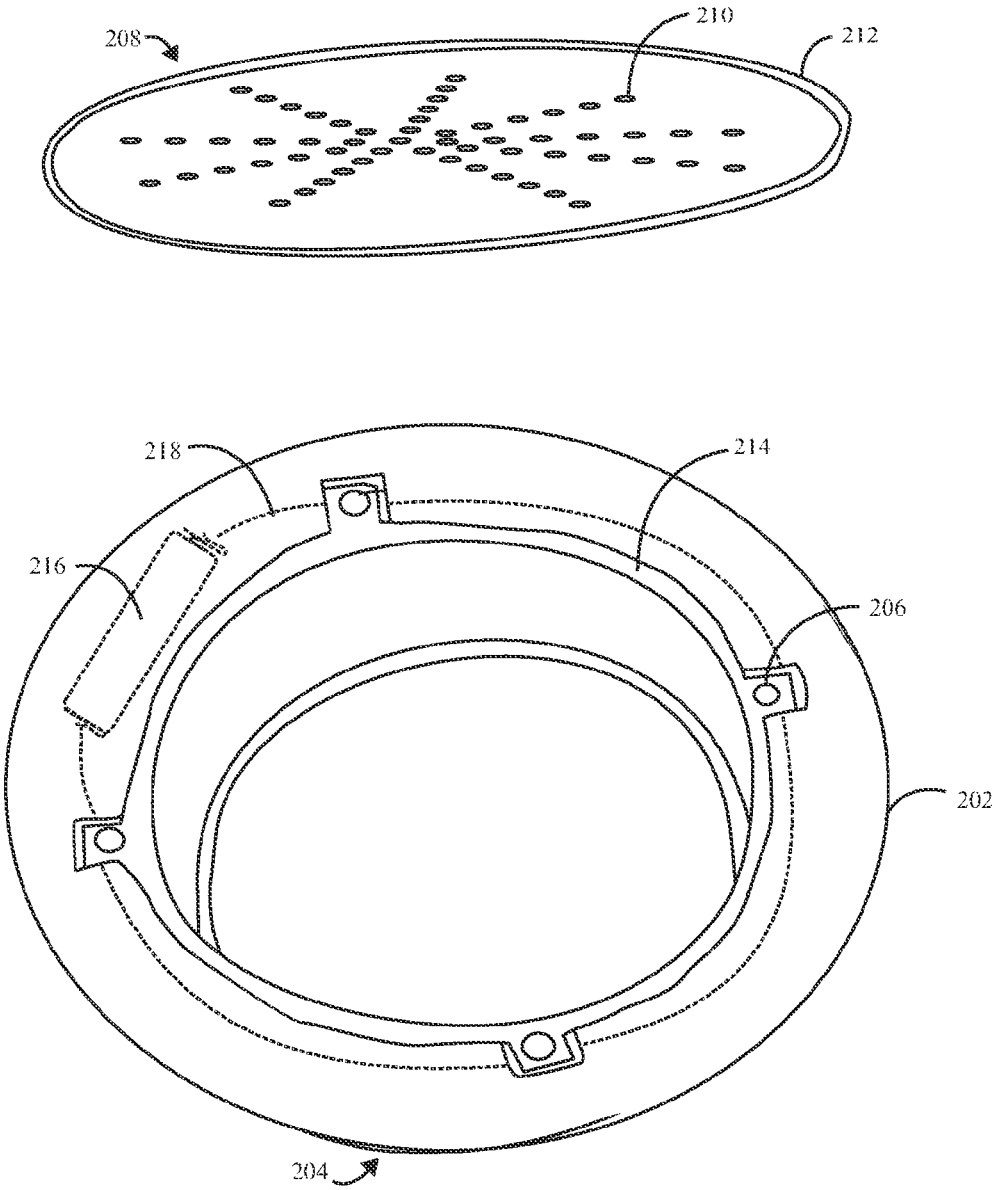
FIG. 2B is a perspective view of the embodiment of FIG. 2A with the display platform and water collection bowl displayed separately, showing a battery placed within the rim of the water collection bowl.

FIG. 2B is a perspective view of the embodiment of FIG. 2A with the display platform 208 and water collection bowl 204 displayed separately. A battery 216 is located beneath the rim of the water collection bowl 204, and is connected by wires 218 to the battery powered lights 206. Some preferred embodiments also include a switch (not shown) that allows the lights 206 to be turned off without removal of the battery 216.

Figure 3A:
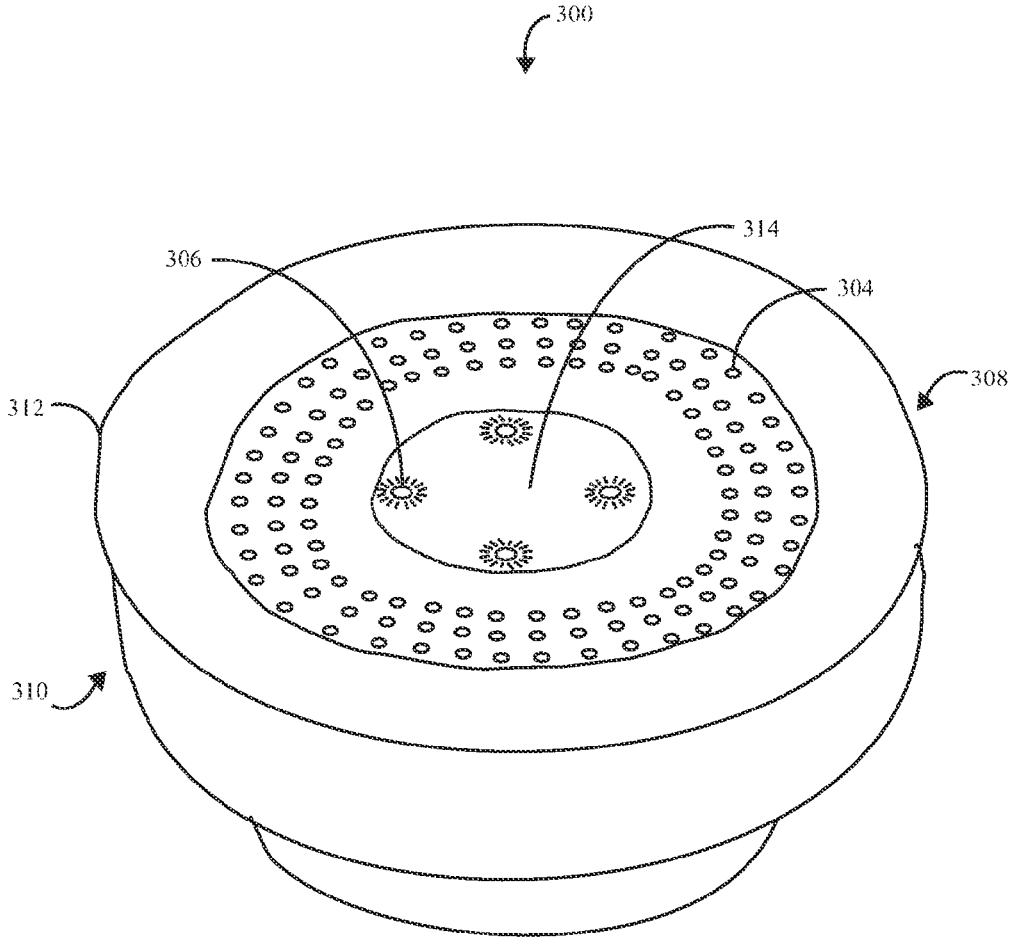
FIG. 3A is a perspective view of an embodiment that includes battery powered lights positioned below the center of the display platform, the display platform being transparent and free of drainage holes in the region directly above the battery powered lights.

FIG. 3A is a perspective view of an embodiment in which a plurality of battery-powered lights 306 are contained within a waterproof container 302 that is located in the center of the water collection bowl 310 beneath the display platform 308. Light from the battery-powered lights 306 shines upward through a transparent section 314 in the center of the display platform 308. A plurality of drainage holes 304 in the display platform 308 allow water from a melting ice sculpture to drain into the water collection bowl 310. The plurality of drainage holes 304 is arranged near the outer rim 312 of the display platform 308 but not directly over the battery-powered lights 306. In various embodiments the display platform 308 is made of a transparent material such as glass or Lucite.

Figure 3B:
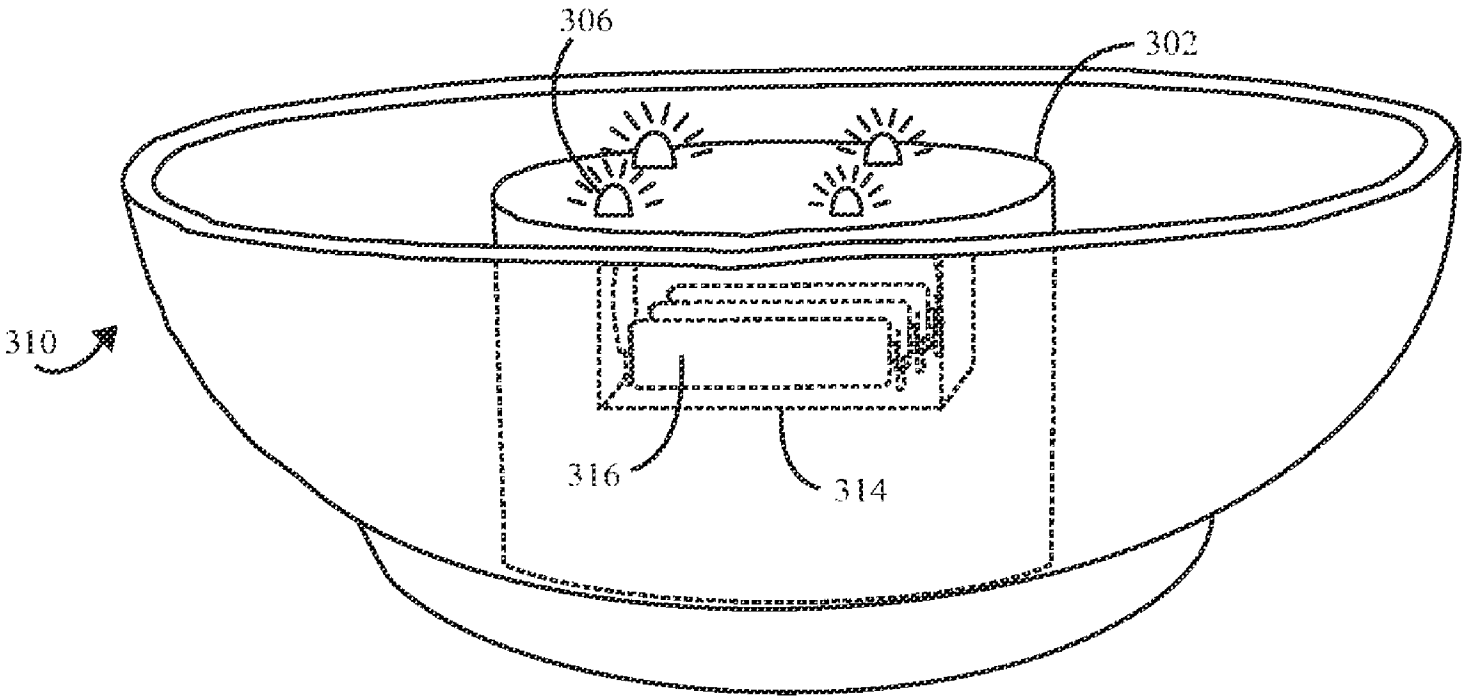
FIG. 3B is a perspective view of the water collection bowl of FIG. 3A, showing a plurality of batteries placed within a waterproof container directly below the battery powered lights.

FIG. 3B is a side view of water collection bowls 310 of FIG. 3A, showing the waterproof container 302 placed within the water collection bowl 310. A plurality of batteries 316 is placed cooperatively with the interior of the waterproof container 302 below the battery powered lights 306. In various embodiments, the battery-powered lights 306 are incandescent lights or LEDs. In the embodiment of FIG. 3A and FIG. 3B, the battery-powered lights 306 are resistant to water exposure.

Other modifications and implementations will occur to those skilled in the art without departing from the spirit and the scope of the invention as claimed. Accordingly, the above description is not intended to limit the invention except as indicated in the following claims.

What is claimed is:

1. An apparatus suitable for displaying and illuminating an ice sculpture, the apparatus comprising:

a water collection bowl;

a display platform located above the water collection bowl, and having dimensions and load-bearing capacity sufficient to support the ice sculpture, the display platform also having at least one drainage hole that is able to allow melting water to drain into the water collection bowl; and a battery-powered light source configured so as to illuminate the ice sculpture, the battery-powered light source being attached to at least one of: the display platform and the water collection bowl.

2. The apparatus of claim 1, wherein the display platform can rest on the water collection bowl.

3. The apparatus of claim 1, wherein the display platform can be attached to the water collection bowl.

4. The apparatus of claim 1, wherein the display platform can form a water-tight seal with the water collection bowl.

5. The apparatus of claim 1, wherein the display platform includes a plurality of drainage holes that can allow melting water to drain into the water collection bowl.

6. The apparatus of claim 1, wherein the battery-powered light source is an incandescent light.

7. The apparatus of claim 1, wherein the battery-powered light source is an LED light.

8. The apparatus of claim 1, wherein the battery-powered light source is supported by an outer rim of the display platform.

9. The apparatus of claim 1, wherein the battery-powered light source is attached to an under-side surface of the display platform.

10. The apparatus of claim 1, wherein at least a portion of the display platform is transparent, and the battery-powered light source is configured so as to illuminate the ice sculpture by transmitting light through the transparent portion of the display platform.

11. The apparatus of claim 10, wherein the display platform does not include any drainage holes located directly above the battery-powered light source, thereby avoiding exposure of the battery-powered light source to draining water.

12. The apparatus of claim 1, wherein the battery-powered light source is supported by a rim of the water collection bowl.

13. The apparatus of claim 1, wherein the battery-powered light source is impervious to water.

14. The apparatus of claim 1, wherein the battery-powered light source is enclosed within a water-resistant enclosure.

15. The apparatus of claim 1, wherein the apparatus includes a plurality of battery-powered light sources.

16. The apparatus of claim 1, wherein the battery is surrounded by a water-resistant enclosure.

17. The apparatus of claim 1, wherein the battery is attached to an under-side surface of the display platform.

18. The apparatus of claim 1, wherein the battery is supported by an interior surface of the water collection bowl.

19. The apparatus of claim 1, wherein the battery is attached under a rim of the water collection bowl.

* * * * *